US006981447B2

(12) United States Patent
Klein et al.

(10) Patent No.: US 6,981,447 B2
(45) Date of Patent: Jan. 3, 2006

(54) METHOD AND APPARATUS FOR LOADING AND UNLOADING FLEXOGRAPHIC PLATES FOR COMPUTER-TO-PLATE IMAGING

(75) Inventors: Thomas Klein, Wolfenbuettel (DE); Jan Buchweitz, Huje (DE)

(73) Assignee: Esko-Graphics A/S, Ballerup (DK)

( * ) Notice: Subject to any disclaimer, the term of this patent is extended or adjusted under 35 U.S.C. 154(b) by 0 days.

(21) Appl. No.: 10/791,305

(22) Filed: Mar. 2, 2004

(65) Prior Publication Data

US 2004/0221758 A1 Nov. 11, 2004

Related U.S. Application Data

(60) Provisional application No. 60/461,706, filed on Apr. 9, 2003.

(51) Int. Cl.
*B41L 47/14* (2006.01)
*B65H 1/04* (2006.01)

(52) U.S. Cl. ..... 101/477; 414/796.7; 414/331.14

(58) Field of Classification Search ..... 101/477, 101/483, 401.1; 414/796.6, 797, 331.01, 414/331.11, 331.14, 331.16, 796.7, 796.88, 414/796.9

See application file for complete search history.

(56) References Cited

U.S. PATENT DOCUMENTS

| | | | | | |
|---|---|---|---|---|---|
| 4,354,336 | A | | 10/1982 | Azzaroni | 53/505 |
| 4,539,794 | A | * | 9/1985 | Azzaroni | 53/493 |
| 4,611,967 | A | | 9/1986 | Tsutsui | 414/411 |
| 4,878,799 | A | | 11/1989 | Seto et al. | 414/331 |
| 5,127,328 | A | | 7/1992 | Wieland | 101/415.1 |
| 5,246,326 | A | * | 9/1993 | Boutet | 414/609 |
| 5,738,014 | A | | 4/1998 | Rombult et al. | 101/477 |
| 5,964,156 | A | | 10/1999 | Smith et al. | 101/471 |
| 5,992,324 | A | | 11/1999 | Rombult et al. | 101/477 |
| 6,085,657 | A | | 7/2000 | Rombult et al. | 101/471 |
| 6,113,346 | A | | 9/2000 | Blake et al. | 414/811 |
| 6,189,452 | B1 | | 2/2001 | Halup et al. | 101/415.1 |
| 6,341,932 | B1 | | 1/2002 | Otsuji | 414/403 |
| 6,354,208 | B1 | | 3/2002 | Bos et al. | 101/463.1 |
| 6,422,801 | B1 | | 7/2002 | Solomon | 414/416.07 |
| 6,536,344 | B2 | | 3/2003 | Kawamura et al. | 101/477 |
| 2003/0001946 | A1 | | 1/2003 | Nomoto et al. | 347/254 |

* cited by examiner

*Primary Examiner*—Leslie J. Evanisko
(74) *Attorney, Agent, or Firm*—Dov Rosenfeld; Inventek

(57) ABSTRACT

A method and apparatus to aid the loading and unloading of flexographic plates to and from an imager. The apparatus includes a magazine containing a plurality of compartments each for holding a single flexographic plate, the compartments arranged vertically, and movable in a vertical direction, a lifting mechanism to lift and lower the compartments; and a control system to control the lifting and lowering by the lifting mechanism. The control system is such that a particular compartment is moved from its rest vertical position at a rest horizontal position to a loading vertical position and a loading horizontal position at which the particular compartment is at a height for loading onto the imager.

17 Claims, 12 Drawing Sheets

METHOD AND APPARATUS FOR LOADING AND UNLOADING FLEXOGRAPHIC PLATES FOR COMPUTER-TO-PLATE IMAGING

RELATED APPLICATION(S)

This invention claims priority of U.S. Provisional Patent Application No. 60/461,706 titled METHOD AND APPARATUS FOR LOADING AND UNLOADING FLEXOGRAPHIC PLATES FOR COMPUTER-TO-PLATE IMAGING, filed Apr. 9, 2003. U.S. Provisional Patent Application No. 60/461,706 is incorporated herein by reference.

BACKGROUND

This invention relates to computer-to-plate (CTP, C2P) imaging for flexographic ("flexo") printing, and in particular, to a method and apparatus for loading and unloading flexographic plates onto an imaging device for imaging the flexographic plates.

Flexographic plates designed for CTP imaging are typically photopolymer plates that are pre-sensitized with a Laser Ablation Mask System (LAMS) coating. Such coatings are known to be easily damaged during handling. Pre-sensitized plates, including flexo-plates for flexographic CTP imaging come as a stack with a separation sheet between consecutive plates. In addition, LAMS coated flexographic plates come with a cover sheet that adheres to the top of the LAMS coating to protect it against mechanical damage. This protective sheet is difficult to remove without damaging the LAMS coating or the plate itself. In addition, such plates can be relatively large, up to about 50" by 80", with a thickness of up to about 6 mm. Each such plate can weigh as much as 15 kg.

These properties make plate loading for CTP flexographic imaging relatively complicated. As a result, modern flexographic CTP imagers are manually loaded and unloaded. Plate loading tables are available that help the manual process. Such tables are either movable, e.g., on wheels, or are integrated into the machine itself. Each plate, e.g., pre-loaded on the loading table, is carried individually from the plate storage area to the CTP flexographic imager, and, after imaging is completed, carried further onwards, e.g., to a processing area where to be processed by a processing system, e.g., exposed by a UV exposure unit then processed by a chemical processing unit.

The requirement to move the plates one-by-one significantly slows down the workflow. With a typical state-of-the art system using a transportable loading table, for a large plate, it may take about 2 minutes to load a first plate, about 10 minutes to image the first plate, about 2 minutes to unload the first plate, about 5 minutes to carry the first plate to the UV exposure unit of the processing system, then 2 minutes to load a second plate, and so forth. Thus, for 10 minutes imaging time, there is about 9 minutes of downtime. This is approximately 45% of the total time.

The efficiency can be increased if more than one operator is involved, e.g., a second operator to transport and load the second plate while the first plate is being transported to the processing area. However, an additional operator is relatively expensive.

There thus is a need to improve the overall productivity of flexographic plate imaging, especially in a single operator environment, by improving the loading and unloading.

FIG. 2 shows a prior art CTP imaging system that is described in U.S. Pat. No. 6,341,932 to Otsuji titled PLATE FEEDING APPARATUS AND METHOD, incorporated herein by reference, and referred to herein as the "Otsuji system." The Otsuji system comprises a plate feeding apparatus 2 that includes a multiple cassette station 5 having a plurality of cassettes 7 arranged one over the other, each cassette holding a stack of plates. The Otsuji system also comprises a loader 6 that includes a slide mechanism for horizontally moving a particular one of the plurality of cassettes from the stack to the loader and a lift mechanism for supporting and vertically moving the particular cassette 7 to a plate feed position. A transport mechanism in loader 6 transports a plate from the particular cassette to the image recording apparatus (imager) after the particular cassette is at the plate feed position. The imager is not shown in FIG. 2, but is behind the two mechanisms 5 and 6 so that feeding a plate involves moving a plate into the plane of the page. The loader 6 includes a slip sheet discharge mechanism that picks up and discharges slip sheets each disposed between an adjacent pair of the plates in the particular cassette 7 at the feed position.

FIG. 3 is taken from U.S. Pat. No. 5,738,014 to Rombult, et al. titled METHOD AND APPARATUS FOR MAKING LITHOGRAPHIC PRINTING PLATES IN AN AUTOMATED COMPUTER TO PLATE IMAGING SYSTEM, and incorporated herein by reference. FIG. 3 shows a CTP imaging system 16, referred to herein as the "Rombult system" that includes a plate handler 18 that contains a supply of plate cassettes 24. The handler 18 can hold as few as two cassettes or as many as three, four, or five depending on user requirements. Each cassette 24 is a light tight container that houses a stack of plates 26, typically lithographic plates. The cassettes 24 can be vertically adjusted by the handler 18 to make plates 26 stored within a particular cassette available to a plate shuttle mechanism (a plate picker 28). The picker 28 removes a single plate from the stack in the selected cassette and transports the plate between the handler 18 and an imager 20. The primary function of the handler 18 is to make plates available on demand to the imager 20. Between each plate in a stack there may be a protective interleaf sheet or slip sheet that is removed by the handler and discarded by a slip sheet removal mechanism 25. The Rombult system 16 includes an optional on-line plate processor and stacker to process the plates after exposure by the imager 20. The Rombult system 16 is controlled by a controller 30.

Each cassette in the Otsuji system and the Rombult system stores a stack of a plurality of pre-sensitized plates with a slip sheet between the plates. One use of the Otsuji system and the Rombult system is for each cassette to store a stack of plates of a different size and/or different thickness so that different size/thickness plates are always available to the imager.

The present invention further addresses a different problem. In practice, it is very difficult to stack flexographic plates. The operation of removing the protective sheet on top of the LAMS coating is a relatively delicate operation not readily automated. Thus a system such as the Otsuji system or the Rombult system wherein each cassette includes a plurality of plates may not be suitable for flexographic plates. The Rombult system patent acknowledges that it is for lithographic CTP imaging for the purpose of supplying the plates of the appropriately sized cassette on demand, and is shown operating with an internal drum scanner. Size is also an important consideration. The Otsuji system's plate feeding apparatus 2 includes a cassette station 5 and a loader 6 that each requires about the same floor area.

Thus there still is a need for a method and apparatus to aid in the loading and unloading of LAMS-coated flexographic plates for CTP imaging.

Flexographic plates can be relatively large, so that there is a need for a loading method and apparatus for flexographic plates that is economical in floor area requirements.

SUMMARY

Described herein are a method and apparatus to aid the loading and unloading of flexographic plates to and from an imager. The apparatus includes a magazine containing a plurality of compartments each for holding a single flexographic plate, the compartments arranged vertically, and movable in a vertical direction, a lifting mechanism to lift and lower the compartments; and a control system to control the lifting and lowering by the lifting mechanism. The control system is such that a particular compartment is moved from its rest vertical position at a rest horizontal position to a loading vertical position at which the particular compartment is at a height for loading onto the imager.

In one embodiment, each compartment, when at its loading vertical position, is movable horizontally from and to the rest horizontal position to and from a loading horizontal position suitable for loading and unloading the plate on the compartment onto and from the imager.

In one embodiment, the lifting mechanism is operative to lift and lower the complete magazine of compartments. The control system controls the lifting and lowering of the magazine until a selected one of the compartments is at its loading vertical position.

In another embodiment, the lifting mechanism is operative to lift and lower the compartments of the magazine one compartment at a time. In one version, the respective rest positions of each of the compartments are lower than the loading vertical position such that a particular compartment pre-loaded with a plate is lifted from its rest vertical position to the loading vertical position, then moved while at the loading vertical position to the loading horizontal position for loading onto the imager.

Other features and variations will be clear from the detailed description below, including the drawings.

DETAILED DESCRIPTION

Described herein is a method and apparatus to aid the loading and unloading of sensitive plates that are difficult to stack one on top of the other, such as flexographic plates. The loading and unloading is onto and from a CTP imager. In one embodiment, the CTP imager is an external drum imager.

To speed up the plate handling process, a plate magazine containing a plurality of flexographic plates is used. One embodiment can contain at least 10 plates, e.g., about 20 plates. The magazine includes a plurality of compartments, one compartment for each plate. Each flexographic plate is pre-loaded in its own compartment, e.g., without the separation sheet that may have been used between plates from in a stack of flexographic plates and without the protective sheet over the LAMS coating.

Note that in another embodiment, the protective sheet is still on top of each flexographic plate and is removed directly prior to the plate being mounted on the drum. In yet another embodiment, the protective sheet is still on top of each flexographic plate and is removed at the same time as the mounting.

In one embodiment the plate magazine pre-loaded with plates is transported to a location adjacent to the flexographic imager, so that plates are immediately available for imaging. In another embodiment, the plate magazine is integrated with the CTP imager.

Figure 1:
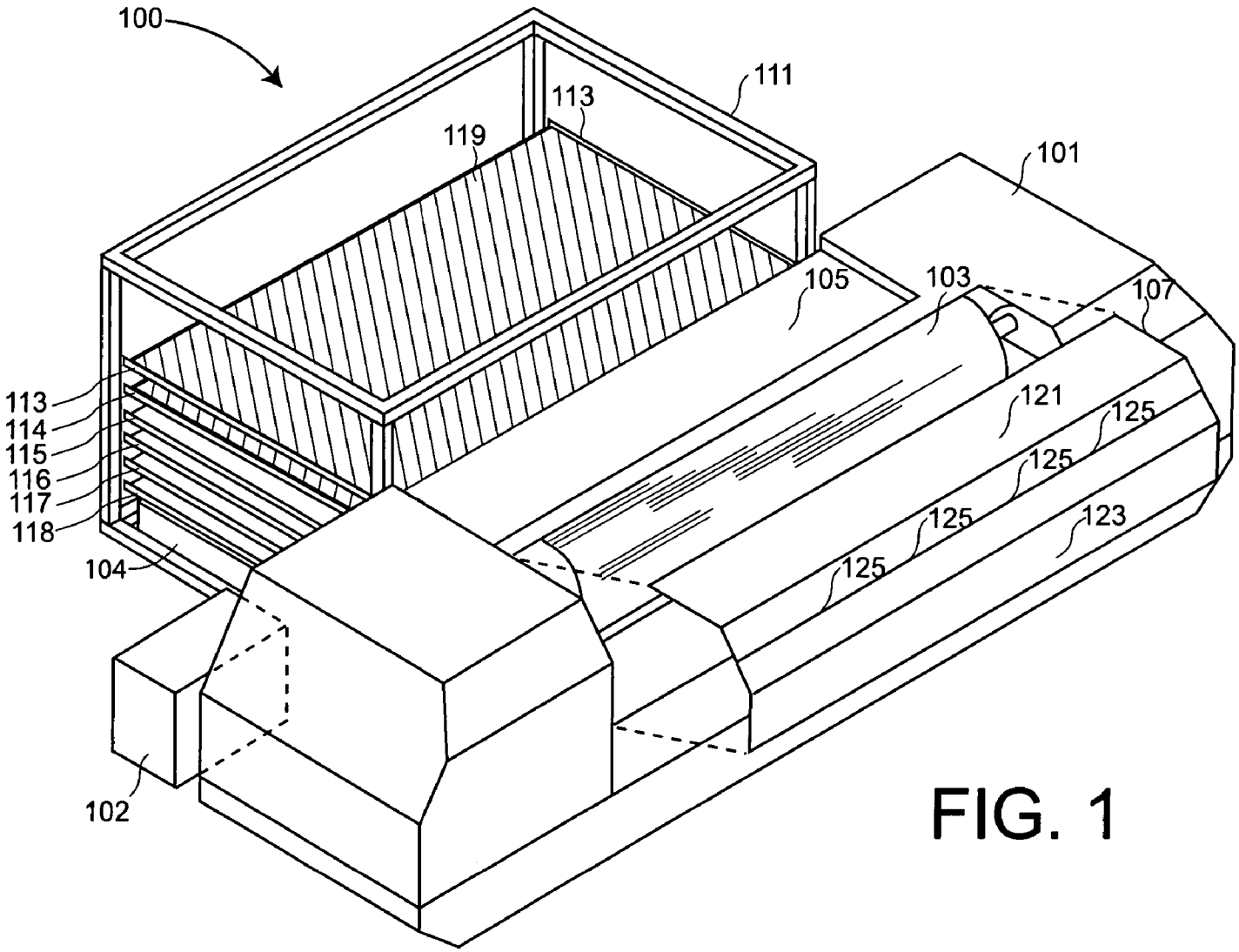
FIG. 1 shows in simplified form one embodiment of a CTP flexographic plate loading and unloading apparatus and an imager for imaging on CTP flexographic plates.
Figure 2:
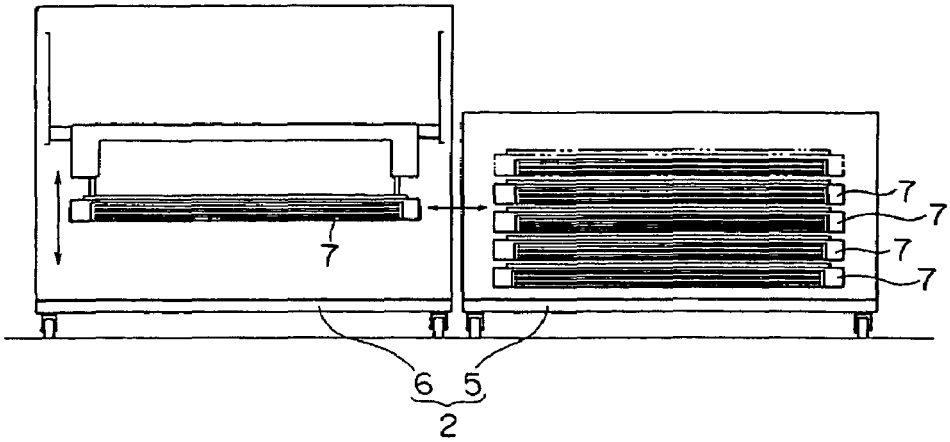
FIG. 2 (PRIOR ART)
FIG. 2 shows a prior art plate loading system that uses cassettes in which a stack of unexposed plates, e.g., CTP lithographic plates is kept.
Figure 3:
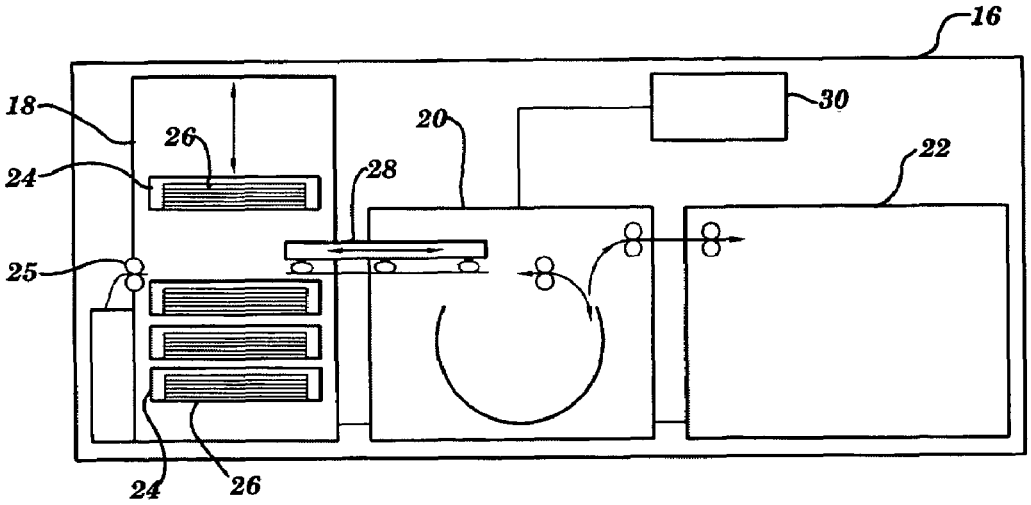
FIG. 3 (PRIOR ART)
FIG. 3 shows another prior art plate loading system that uses cassettes in which a stack of unexposed plates, e.g., CTP lithographic plates is kept.

FIG. 1 shows one embodiment of a system 100 that includes an external drum imager 101 for flexographic plates and a novel loader that includes a magazine containing a plurality of compartments each for holding a single flexographic plate.

One embodiment of the imager 101 includes a rotatable drum for loading a flexographic plate thereon. A door mechanism 107 provides access to the drum for loading and unloading and is closed during imaging. In order to show the drum in FIG. 1, the door mechanism 107 is shown removed from its proper location as indicated by the dashed lines. One embodiment of the door mechanism includes a first door part 121 and a second door part 123 hinged to each other by hinge 125. The two door parts 121 and 123 further include hinges not shown so as not to obscure the inventive aspects. The imager 101 includes a laser source (or several laser sources) that provides one or more laser beams modulated by imaging data, e.g., sets of data for each of a plurality of color separations for exposing the respective plates for a color print. The laser(s) is/are suitable for exposing CTP flexographic plates, e.g., is/are matched in energy and wavelength to the particular type of LAMS coating on the flexographic plates. An example of one such flexographic imager 101 is the Esko-Graphics Cyrel® Digital Imager (Esko-Graphics, Gent, Belgium) made by Esko-Graphics, the assignee of the present invention.

In order not to obscure the inventive aspects, the magazine is shown in FIG. 1 in simplified form and having only six compartments that are spaced further apart than in an actual embodiment.

In one embodiment, the magazine includes a frame 111 and a set of compartments 113, 114, 115, 116, 117, and 118 arranged vertically, each compartment designed for holding a single flexographic plate. The top compartment is compartment 113, and the bottom compartment is compartment 118. FIG. 1 shows a plate 119 in the top compartment 113 and another plate in the next compartment 114. The compartments are movable up and down. A lifting mechanism 104—part of which is shown in FIG. 1—lifts and lowers the compartments under control of a control system 102. Initially, each of the compartments is at its respective rest vertical position and a common rest horizontal position.

In one embodiment, the lifting mechanism moves one compartment at a time vertically between its rest vertical position and a loading vertical position at which the compartment is at a height at which the compartment is horizontally movable back and forth from the rest horizontal position to a loading horizontal position flush with a loading area 105. The lifting mechanism 104 further can move each compartment at the rest horizontal position up and down from and to the loading vertical position to and from a respective imaged vertical position.

Note that while in the embodiment shown, the compartments' respective rest positions are bottom positions and the respective imaged positions are the compartments' respective top positions, in other embodiments, the order is reversed, e.g., the rest positions are top positions.

In one embodiment, the loader is movable. One version has wheels attached to the bottom of the supporting frame 111. Note that the wheels are not visible in FIG. 1. The loader is moved from an in initial location (the storage location) at which it is loaded with unexposed flexographic plates, one per compartment with no protective cover sheet, to a location adjacent to the imager 101 (the imaging location) as shown in FIG. 1.

After the plates are each imaged according to imaging data provided to the imager, in one embodiment, the loader is moved from the imaging location to a location (the processing location) where each plate is processed.

By having the compartments pre-loaded, with the protective cover sheets removed, the step of unstacking the plates and removing the protective cover sheets can be done separately at the storage location, such that these steps do not interfere with the loading of the plates on to the imager.

As described above, in another embodiment, the protective sheet is removed directly prior to loading the flexographic plate on the drum, and in yet another embodiment the protective sheet removal occurs during the plate loading cycle.

Figure 4A:
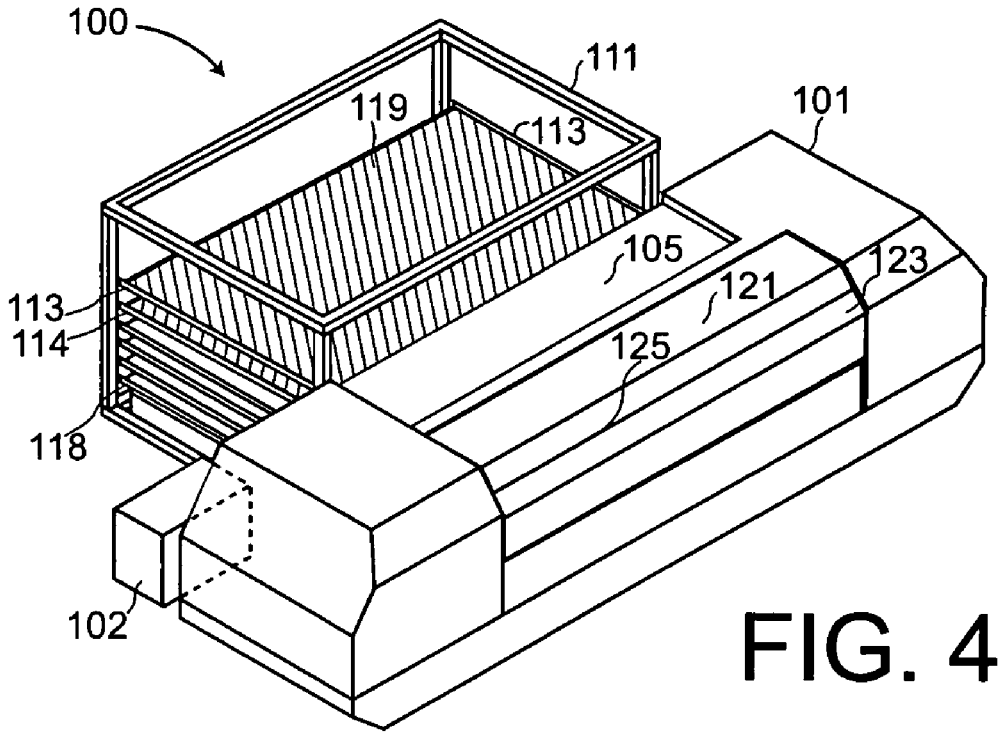
FIG. 4A–4J each shows a different stage of operation of the system shown in FIG. 1.
Figure 4B:
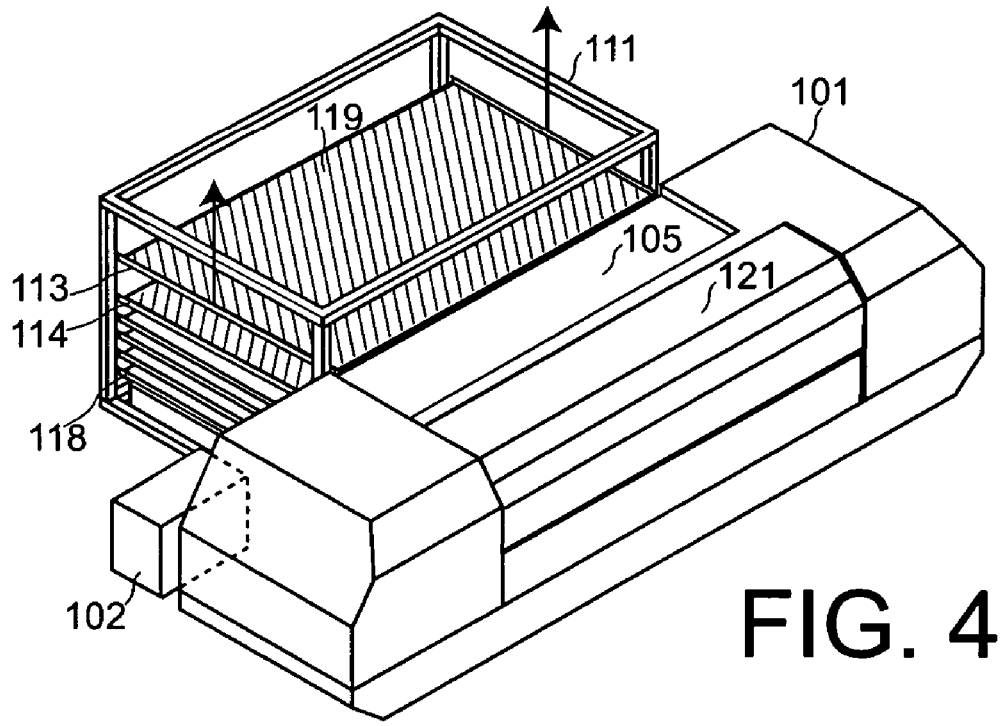
Figure 4C:
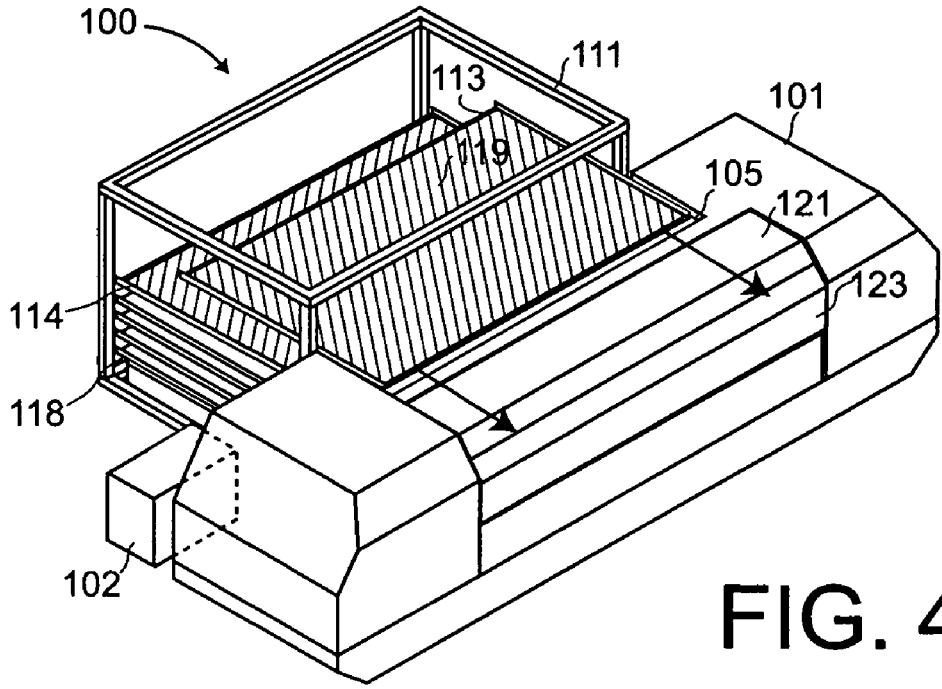

The operation of the plate loader of FIG. 1 is now described in more detail with the aid of FIGS. 4A–4J that show the system of FIG. 1 at different stages of loading, imaging, and unloading. FIG. 4A shows the system with the compartments at their respective rest positions. In a step shown in FIG. 4B, compartment 113 containing CTP flexographic plate 119 is moved up by the lifting mechanism 104. The lifting mechanism under control of control system 102 stops compartment 113 when the compartment reaches the loading vertical position. FIG. 4C shows the compartment 113 at the loading vertical position moving horizontally to the loading horizontal position where it is flush with loading area 105. In one embodiment, the horizontal moving of the compartment uses a motor-driven horizontal movement mechanism under control of the control system 102. The horizontal movement mechanism is described in more detail below. In another embodiment, each compartment includes grips, e.g. on the side of the compartment that provide for the operator to manually move the compartment horizontally.

Figure 4D:
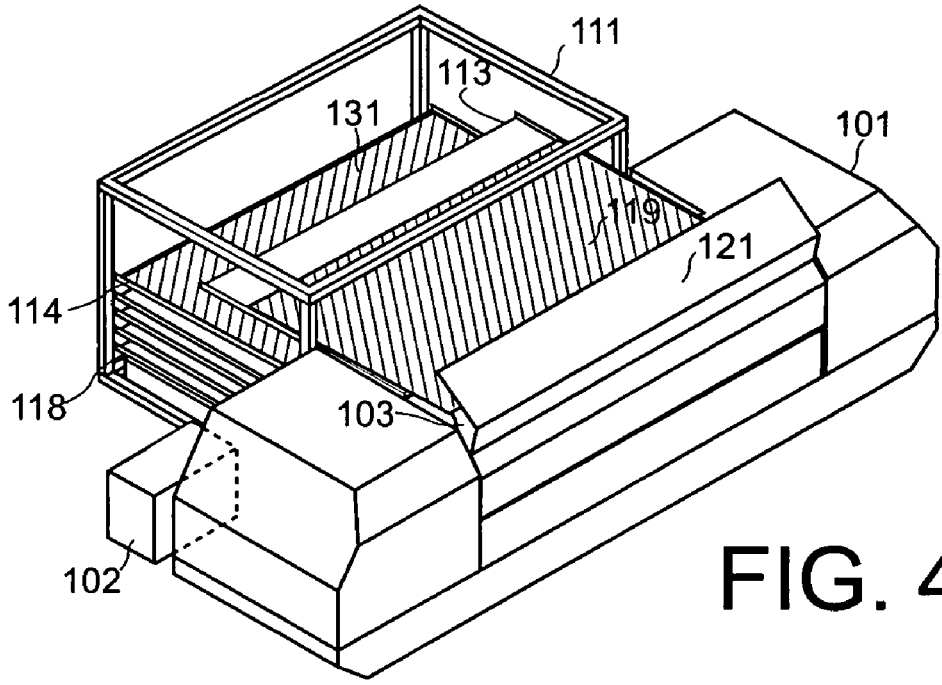
Figure 4E:
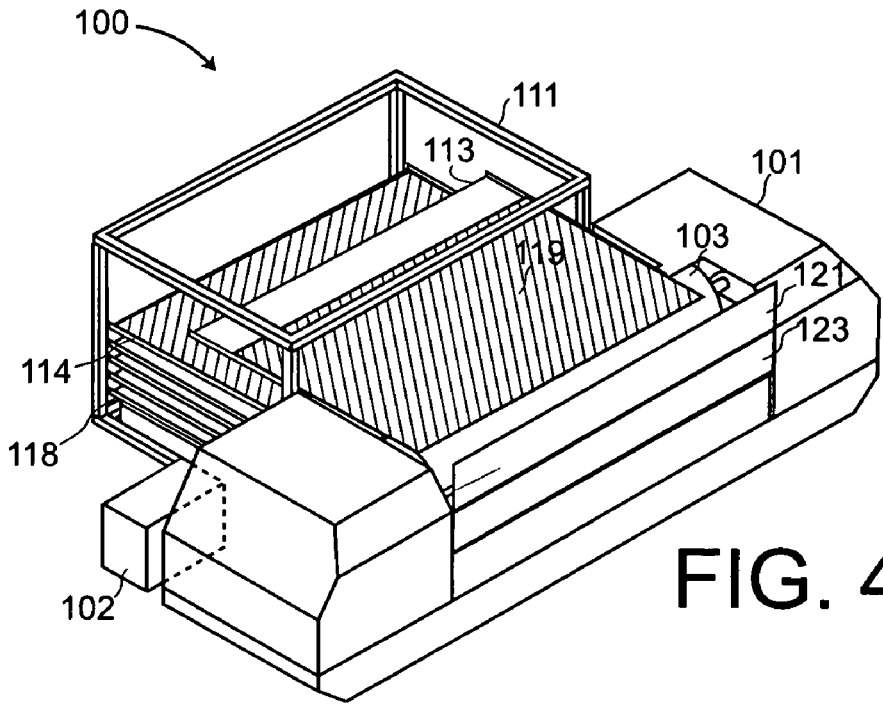
Figure 4F:
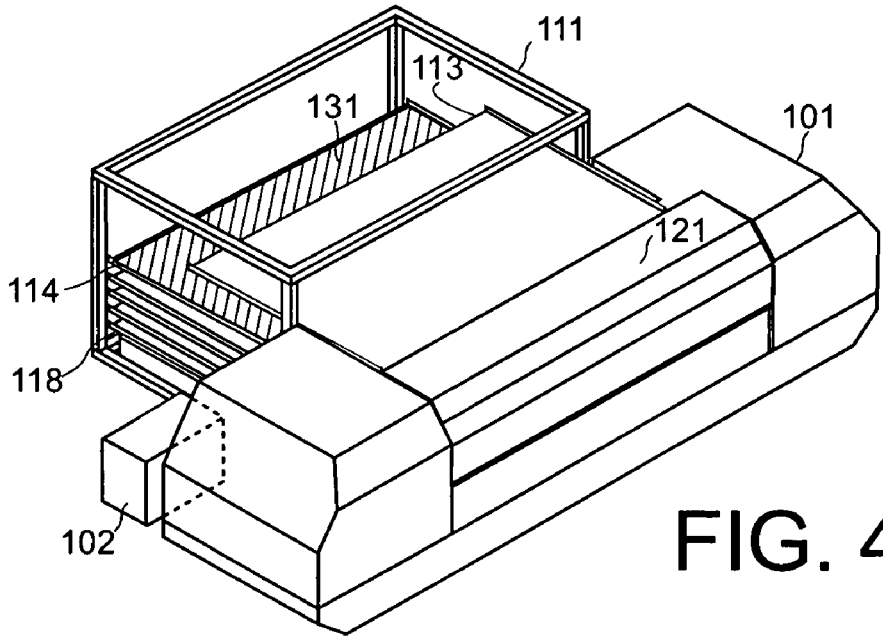
Figure 4G:
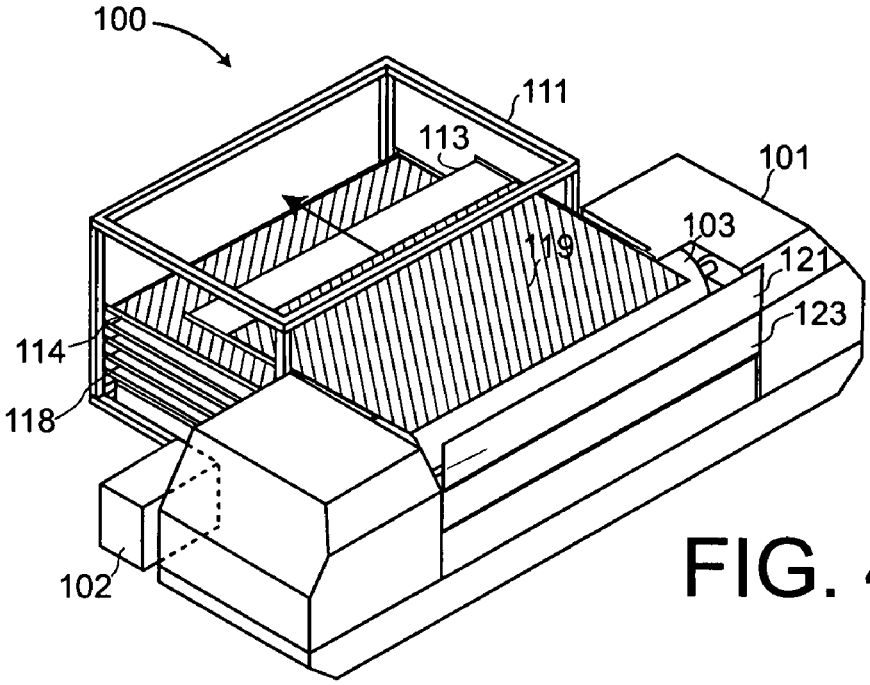
Figure 4H:
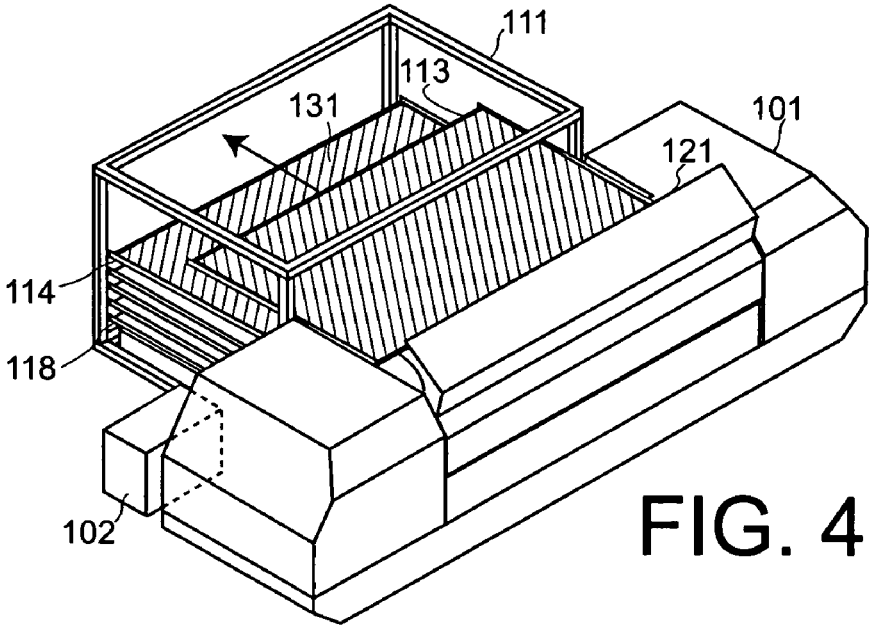
Figure 4I:
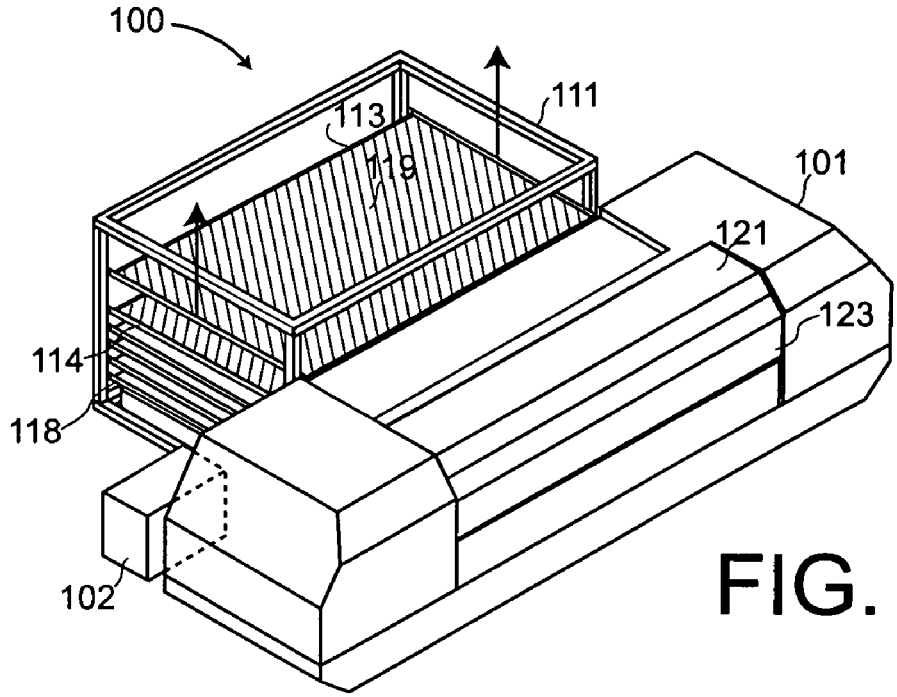
Figure 4J:
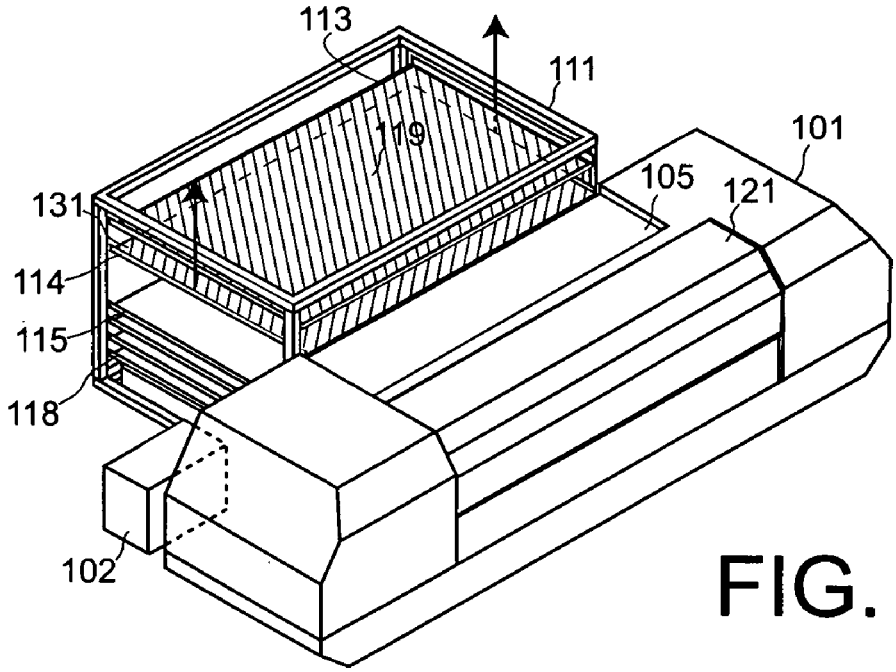

At the same time as the compartment moves horizontally, as shown in FIG. 4D, door part 121 of door 107 opens to allow the flexographic plate to be loaded onto the drum 103. FIG. 4E shows the start of the loading of the plate 119 onto the drum 103 of the imager 101, in one embodiment using a clamping mechanism on the drum 103. The moving of the flexographic plate from the compartment 113 at a loading area 105 to the drum is carried out manually by an operator. The plate 119 is now wrapped around the drum and the door 107 closed. FIG. 4F shows the system during the operation of the imager at which time the plate 119 is imaged according to imaging data. After the imaging, the door 107 is opened to allow for unloading of the plate. FIG. 4G shows the plate being unloaded back onto the compartment 113. Once the imaged flexographic plate 119 is back in its compartment 113, FIG. 4H shows the compartment moving horizontally from the loading horizontal position to rest horizontal position at the loading vertical position. Note that the next plate to be imaged is the plate 131 in compartment 114. FIG. 41 shows the lifting mechanism 104 moving the compartment 113 from the loading vertical position to the compartment's imaged vertical position, which in this embodiment is the topmost position for the compartment. In other embodiments, this may be the bottom vertical position. The loading of plate 131 in compartment 114 now commences. FIG. 4J shows the lifting mechanism 104 lifting compartment 114 from its rest vertical position to the loading vertical position. The loading and imaging and unloading of the next plate 131 proceeds as described above for the first plate 119.

The loading, exposing, and unloading continues until all plates in the compartments are exposed. The magazine with each compartment containing an imaged CTP flexographic plate is now transported to the processing location where the plates are processed.

Alternatively, an imaged plate may also be transported to an outlet compartment for immediate access, e.g., in the case there is a plate that needs to be more urgently made.

Note that FIGS. 4A–4J show the door 107 being closed during the moving of the compartments from their respective rest vertical position to the loading vertical position, and also the moving of the exposed plates from the loading vertical position to their respective exposed vertical positions. Of course there is no need to close and reopen the door 107 during this action, and in another embodiment, the door remains open except during imaging.

Note also that the order of imaging the plates may be random according to the imaging requirements. For example, in the case of a 20 compartment magazine, suppose the different sizes and or types of LAMS-coated flexographic plates are kept in the compartments. If the compartments are numbered 1, 2, . . . , 20, then the order of loading and imaging is not necessarily 1, 2, . . . , 20, but may be 1, 3, 2, 7, 4, and so forth depending on the needs.

Recall that with a state-of-the art prior art manual system using a transportable loading table, for a large plate, it may take about 2 minutes to load a first plate, about 10 minutes to image the first plate, about 2 minutes to unload the first plate, about 5 minutes to carry the first plate to the UV exposure unit of the processing system, then 2 minutes to load a second plate, and so forth. Thus, for 10 minutes imaging time, there is about 9 minutes of downtime. Using the system of FIG. 1, loading the first plate 119 could take 1 minute, imaging the plate 10 minutes, unloading plate 119 another 1 minute, loading plate 131, 1 minute, imaging plate 131, 10 minutes, and so forth. The carrying of the plates to the processing location occurs only after all the plates are imaged. Thus, instead of the 5 minutes per plate, for a loader that contains 20 compartments, the 5-minute time is shared amongst the 20 flexographic plates, which comes to 0.25 minutes per plate. Thus, for 10 minutes imaging time, there is only 2.25 minutes of down time. Thus imaging is more than 81% of the total time.

In one embodiment, any plate may also be accessed by an operator after imaging. In one embodiment, the plate is accessible from the back of the magazine. Thus, an imaged plate may be accessed and removed from its compartment and transported to the processing location while another plate is being imaged. This further increases the imaging efficiency. In yet another embodiment, the unloading is to a separate transportable outlet compartment. Thus the efficiency may be further increased by not waiting until all plates in the magazine are imaged before transporting the imaged plates to the processing location.

Figure 5:
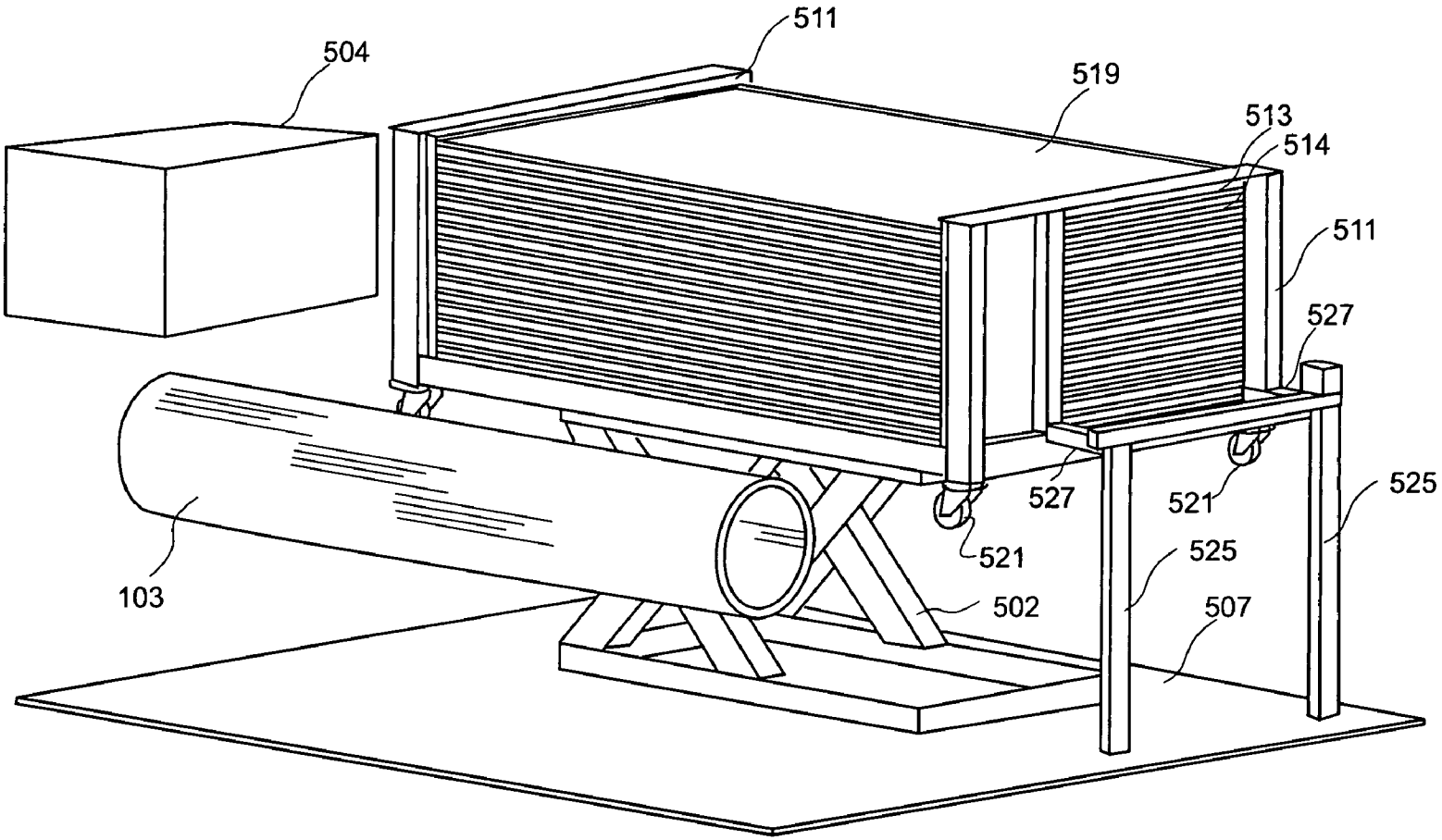
FIG. 5 shows in simplified form an alternate embodiment of a CTP flexographic plate loading and unloading system.

FIG. 5 shows another embodiment in simplified form. Only the drum 103 of the imager 101 is shown so that the operation of the loader is clear. A loader includes a magazine that includes a frame 511. The magazine includes a set of compartments 513, 514, . . . , each able to contain a single CTP flexographic plate and each compartment horizontally movable. One plate is shown as plate 519 in the top compartment 513. One embodiment contains at least 10 compartments, e.g., in the order of 20 compartments. The magazine's frame has wheels 521 so is transportable, e.g., from a storage location to a loading location and from the loading location to a processing location. The magazine is dockable to the loading location that is disposed relative to the imager (not shown) so that a compartment at a vertical position called the loading vertical position can be horizontally moved to and from a horizontal position called the loading horizontal position, in one embodiment in a loading area 105 in the imager (see FIG. 1). The imager 101 and a set of docking posts 525 are attached to a base 507 such that the docking posts 525 are located a certain distance from the imager selected to that any compartment at the loading vertical position can be horizontally moved to the loading horizontal position. The magazine docks onto the docking posts 525 via docking sections 527 that fit within grooves in docking posts 525 and that can slide in the grooves while the magazine is moved up and down using a lifting mechanism 502. The docking posts 525 thus provide a guiding mechanism for the lifting mechanism 502 that moves the magazine containing the compartments up or down under control of a control system 504. The guiding mechanism maintains the compartments in the magazine in a fixed horizontal position during the up and down motion.

Figure 6:
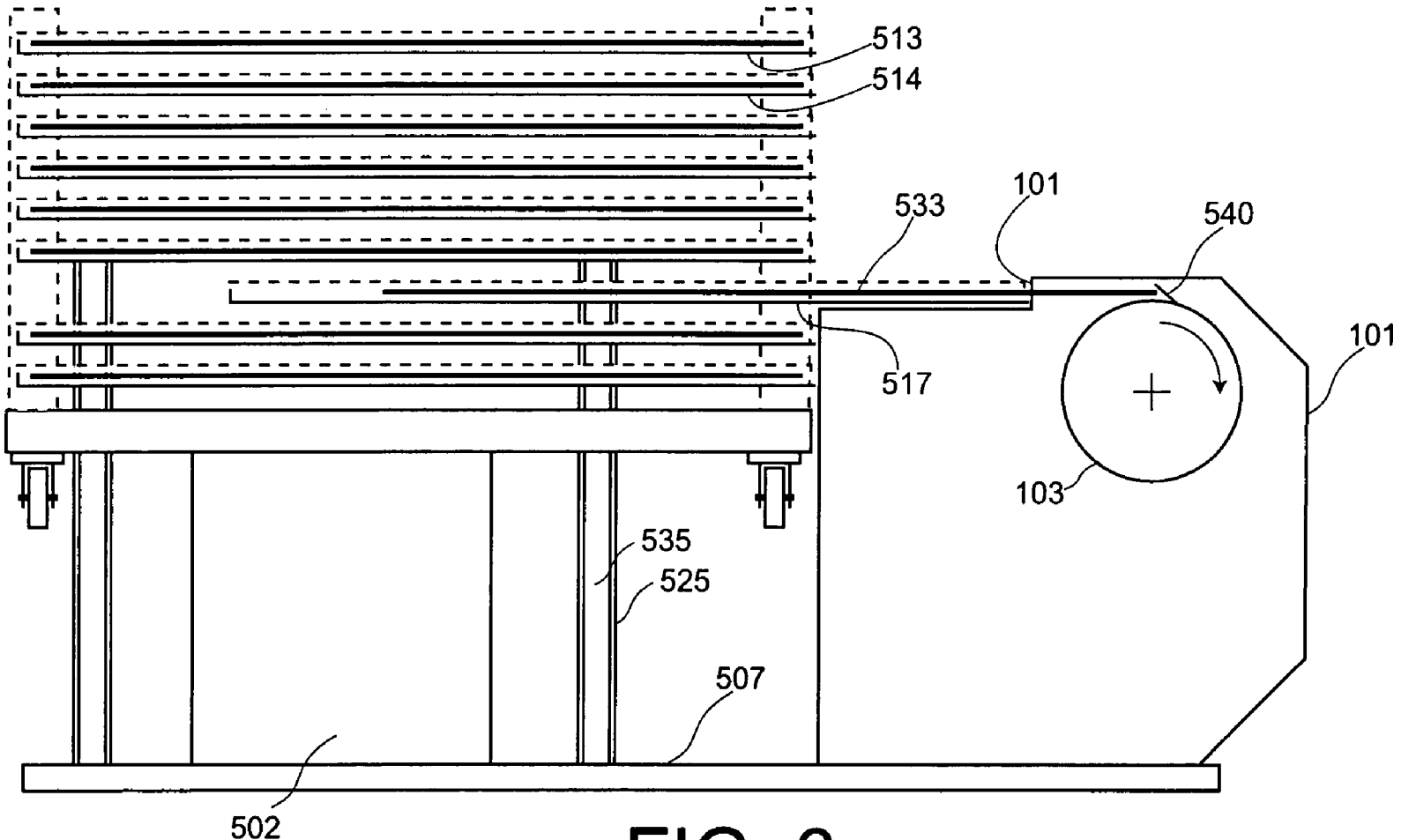
FIG. 6 shows a simplified side view of the magazine and imager according to one embodiment of the invention.

FIG. 6 shows a simplified side view of the magazine and imager 101. When the frame 511 supporting the magazine of compartments is at the docked position, the control system 504 is designed to move the magazine using the lifting mechanism 502 such that a selected compartment is at the loading vertical position adjacent to the loading area 105 of the imager 101. The docking posts 525 include a groove 535 and provides a guiding mechanism for the docking section 527 to aid in guiding the magazine during its up or down motion. When the selected compartment, shown as compartment 517 is at its loading vertical position, the compartment is horizontally movable back and forth from the rest horizontal position to a loading horizontal position flush with a loading area 105. Then the selected compartment is at the loading horizontal position, an operator moves the flexographic plate 533 in the compartment and attaches it to the drum 103, in one embodiment using a clamping mechanism on the drum shown as 540 in FIG. 6. The unimaged flexographic plate is now wrapped around the drum, and the door 107 (not shown in FIG. 6) is closed. The plate is now imaged. After imaging, the imager's door is opened, the imaged plate is unwrapped and unclamped and moved back onto the compartment 517 by the operator. The compartment now is moved from the loading horizontal position to the rest horizontal position and the magazine moved under control of the control system 502 until another desired compartment is at its loading vertical position so that it can be horizontally moved to the loading horizontal position.

Figure 7:
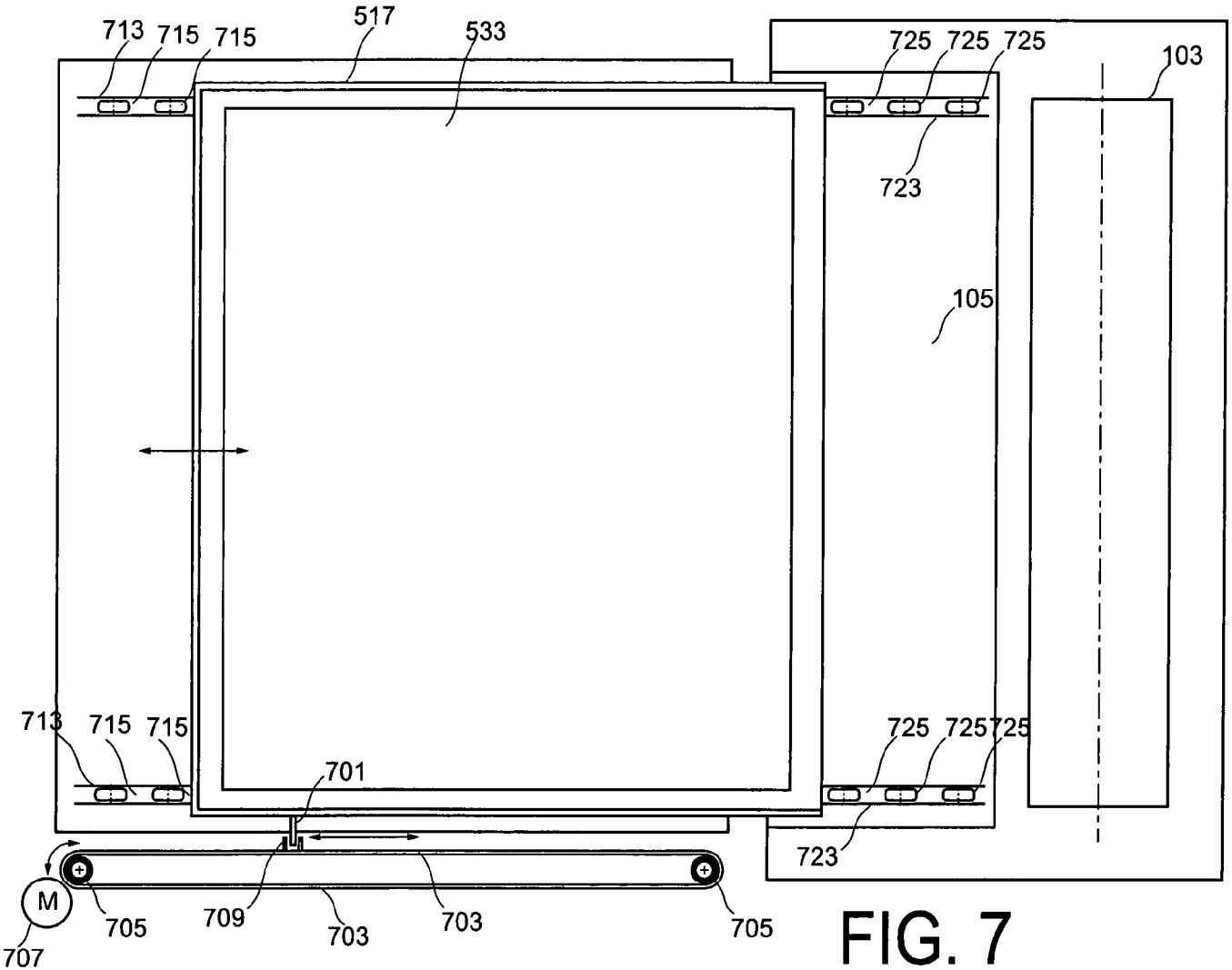
FIG. 7 shows a simplified top view showing one of the compartments in horizontal motion between the rest horizontal position and the loading horizontal position to illustrate one embodiment of the horizontal movement mechanism.

The motor driven horizontal movement mechanism is now described in more detail. FIG. 7 shows a simplified top view showing one of the compartments in horizontal motion between the rest horizontal position and the loading horizontal position. FIG. 7 will be explained for the embodiment shown in FIGS. 5 and 6, and is equally applicable to the embodiment shown in FIGS. 1 and 4A–4J. The horizontal movement mechanism includes a chain drive system having a pair of rotatable sprockets 705 mechanically coupled to cooperate with a chain 703 and transmit rotary motion of the sprockets 705 into linear motion of the chains 703. A motor 707 rotates the sprockets 705 under control of the control system 502. The compartment includes a pin 701 located such that when the compartment is at the rest horizontal position and moved to the loading vertical position, the pin sits in a U-shaped brace 709 that is attached to the chain 703 so that when the sprockets rotate, the U shaped brace and thus the compartment moves horizontally from the rest horizontal position to the loading horizontal position.

In one embodiment, the motor that causes the sprockets 705 to rotate is located near the sprockets at approximately the loading vertical height. In an alternate embodiment, the motor is located at the bottom of the frame and transmits rotary energy to the sprockets 705 by driving a drive shaft coupled to the sprockets 705 via gear boxes and couplings.

In one embodiment, the horizontal movement of the compartment to and from the loading horizontal position is aided by a set of wheels or rollers 715 in a set of supports, e.g., set of rails 713 that are attached to the frame of the magazine. In one embodiment, the wheels 715 and supports 713 are located underneath the compartments so that the compartment rolls on top of the wheels 715 when it is moved horizontally.

It should be noted that the drawings are not to scale. In particular, in one embodiment, when the plate is at the horizontal loading position, the majority of the compartment is away from the frame of the magazine, up to 80% in one version. To support the horizontal motion of the part that is outside the frame, in one embodiment, the loading area 105 of the imager includes a set of a set of wheels or rollers 725 in a set of supports, e.g., set of rails 723 located such that part of the compartment can roll on top of the wheels when the compartment part is on top of area 105.

Figure 8:
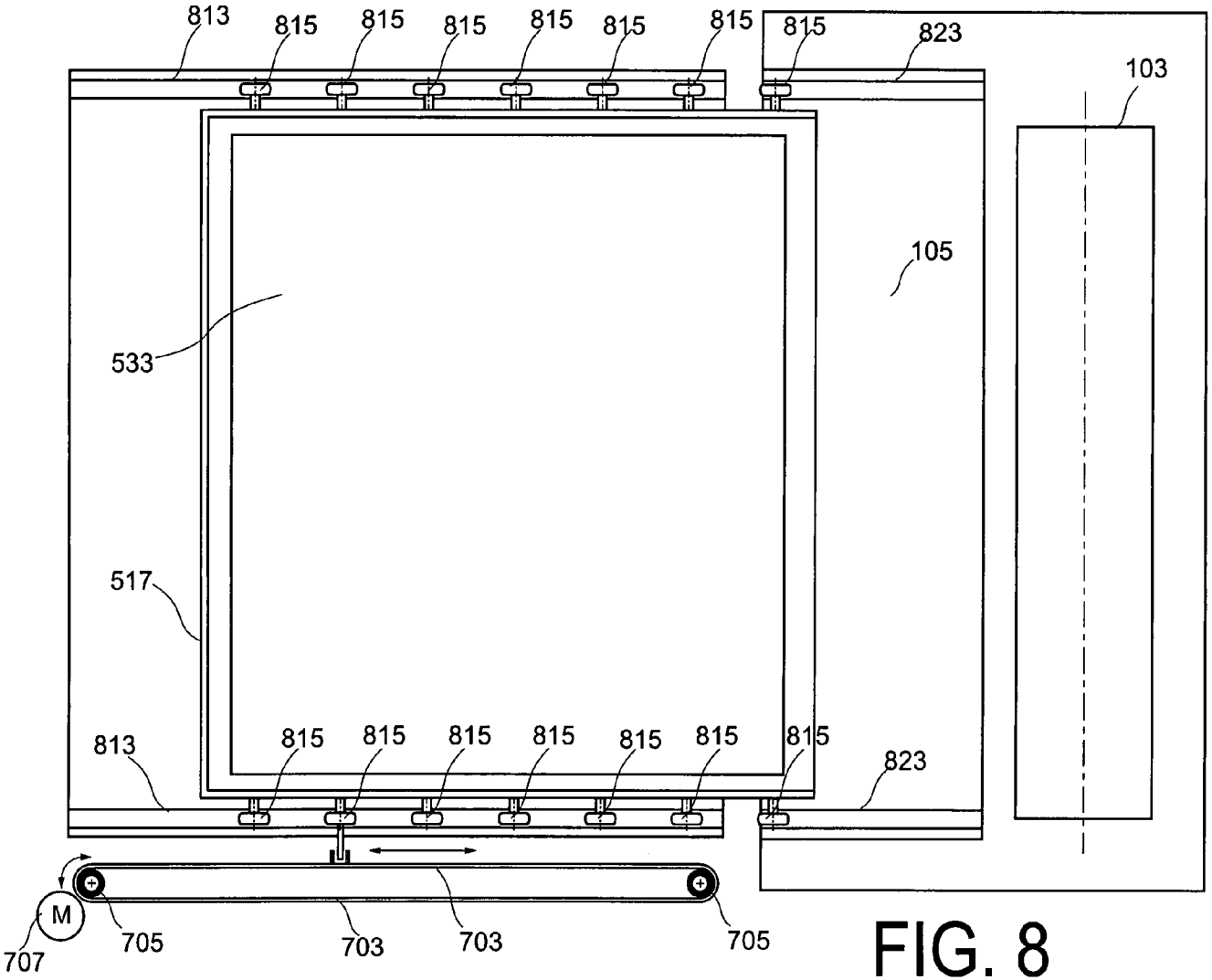
FIG. 8 shows a top view of an alternate embodiment of rollers that provide for horizontal motion using an embodiment of a horizontal movement mechanism.

FIG. 8 shows an alternate embodiment of the wheels that provide ease of horizontal movement of the compartment that is at the loading vertical position. The compartment has a set of guide rollers or wheels 815 attached to each side. The guide rollers 815 are in support rails 813 that are attached to the frame such that the compartment is movable horizontally when it is at the loading vertical position. In one embodiment, a further set of support rails 823 are provided at the load area 105 of the imager 101 such that when the compartment is moved from the rest horizontal position to the loading horizontal position, the further set of support rails 823 provide support of the rollers 815 of that part of the compartment that is over the load area 105.

The lifting mechanisms are now described in more detail. For the embodiment of FIGS. 5 and 6, the lifting mechanism is an hydraulic lift that lifts the complete magazine of compartments under control of the control system 502 until a desired compartment is at the vertical loading position.

Figure 9:
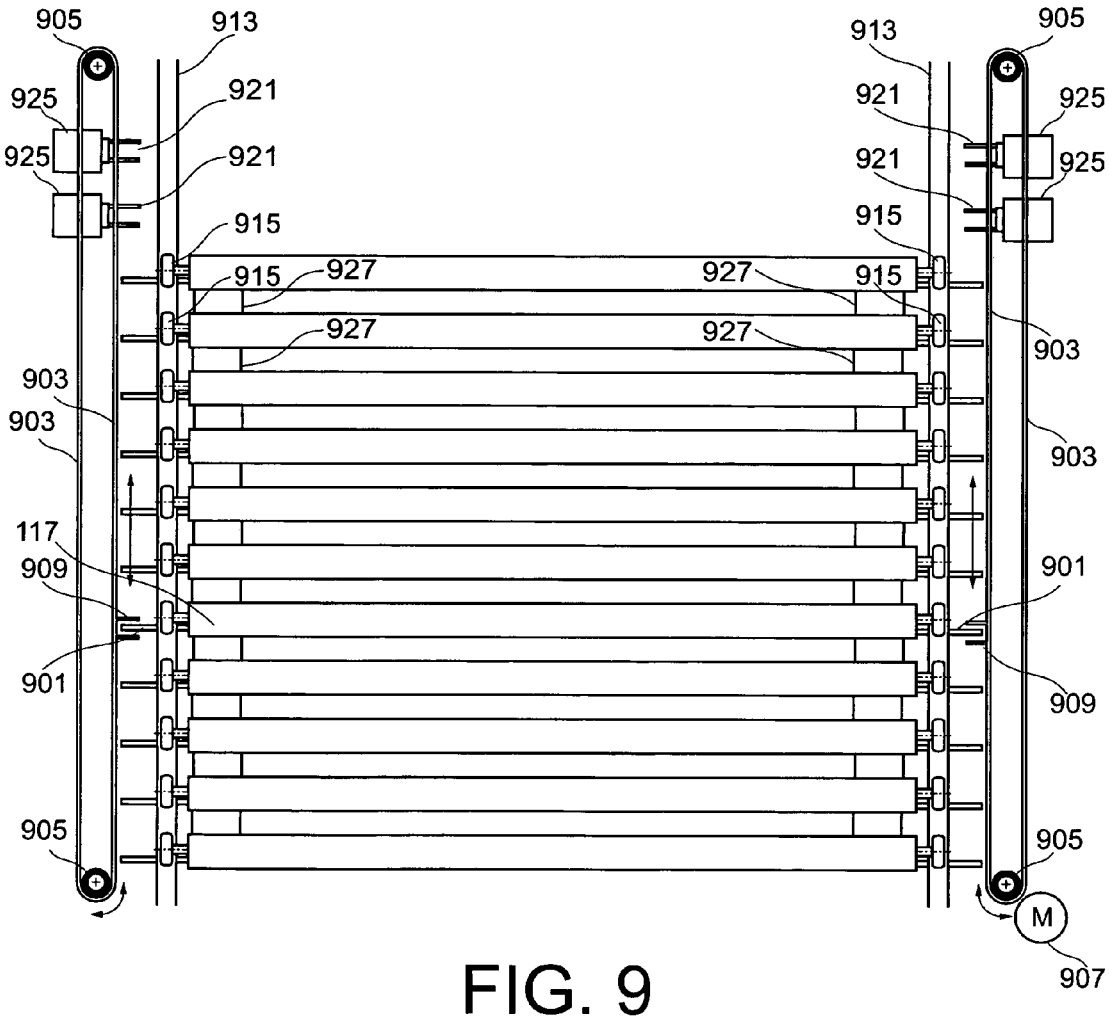
FIG. 9 shows a simplified view of an embodiment of a lifting mechanism suitable for use in the embodiment shown in FIG. 1.

For the embodiments of FIGS. 1 and 4A–4J, FIG. 9 shows a simplified rear view that explains how one embodiment of the lifting mechanism is constructed and functions under control of the control system 102. The support frame 111 includes four vertical support beams provided with guide tracks 913 for guiding each compartment while the compartment is vertically moved. Only two such guide tracks are shown in FIG. 9. Each compartment has four rotatable guide wheels 915 (only two shown per compartment in the view of FIG. 9) that ride in the guide tracks 913 at the corners of each compartment. One embodiment of the lifting mechanism includes a pair of chain drive systems each having a pair of rotatable sprockets 905 mechanically coupled to cooperate with a chain 903 and transmit rotary motion of the sprockets 905 into linear vertical motion of the chains 903. A motor 907 rotates the sprockets 905 under control of the control system 102.

Each compartment includes a pair of outwardly pointing horizontal pins 901 located perpendicular to the direction of horizontal motion. Each chain includes a U-shaped brace 909 that can engage and disengage from a pin (the "engaged" and "unengaged" positions, respectively) when the U-shaped brace is adjacent to the compartment. In one embodiment, the U-shaped braces 909 are rotatable in a horizontal plane between the engaged and unengaged position to respectively engage the pins or not engage the pins of a particular compartment under control of the control system 102. Consider a particular compartment. The U-shaped brace 909 is initially unengaged. When the compartment is in the rest horizontal position, the motor 907 causes the chains to move until the unengaged U-shaped braces 909 are at a height next to the pins 901 of the selected compartment. The selected compartment may now be moved by the braces 909 moving to the engaged position and the motor causing the chain to move the brace that in turn moves the selected compartment until the compartment is at the desired loading vertical position.

In one embodiment, each compartment has a vertical imaged position which is on the top of the magazine. The magazine includes a locking mechanism to lock a compartment in its imaged vertical position. In one embodiment, the locking mechanism includes U-shaped braces 921 attached to the frame by members 925. The braces have an engaged position whereby a corresponding compartment is locked, and an unengaged position. In one embodiment, the engaging and unengaging is by rotating the U-shaped brace so that when engaged, a brace holds the pin 901 of its respective compartment to lock the compartment at the imaged vertical position. The braces for only two imaged vertical positions are shown in FIG. 9.

In one embodiment, spacers 927 between the compartments ensure that any compartments above the selected compartment that are not locked in their respective imaged vertical positions are also moved up and down when the selected compartment is moved up or down.

In one embodiment that uses rails and wheels on the compartments as shown in FIG. 8, the wheels 915 are the end wheels of the wheels 815 shown in FIG. 8. The rails 913 include slots at the loading vertical position to enable the horizontal rails to pass through, and similarly horizontal rails 813 are such that the end wheels that also from wheels 913 can travel vertically.

Alternate lifting mechanisms suitable for adapting to be incorporated into the embodiments of FIG. 1 available in the prior art. Similarly, alternate designs for a lifting mechanism suitable for moving the magazine in frame 511 (FIG. 5) up and down are readily available and would be clear to those in the art.

Thus, a loading/unloading apparatus and method have been described suitable for CTP flexographic plates. The apparatus improves the efficiency of workflows wherein a single plate is transported from a storage location to an imaging location adjacent to an imager, imaged, and then moved to a processing location. Furthermore, flexographic jobs typically need a plurality of sizes and plate types, e.g., plates of different hardness and/or thickness. An advantage of the inventive method and apparatus using a plate magazine providing one compartment for each plate can satisfy this need.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

All publications, patents, and patent applications cited herein are hereby incorporated by reference.

Thus, while there have been described what are believed to be preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

What is claimed is:

1. An apparatus to aid loading and unloading of flexographic plates to and from an imager, comprising:

a magazine containing a plurality of compartments each for holding a single flexographic plate, the compartments arranged vertically, and movable in a vertical direction, each respective compartment having a respective rest vertical position at a rest horizontal position, each respective compartment further having a loading vertical position at which the respective compartment is at a height for loading onto the imager;

a lifting mechanism to lift and lower the compartments; and a control system to control the lifting and lowering by the lifting mechanism, such that a particular compartment is moved from its rest vertical position at the rest horizontal position to the loading vertical position at which the particular compartment is at the height for loading onto the imager or unloading from the imager, wherein each compartment, when at its loading vertical position, is movable horizontally from and to the rest horizontal position to and from a loading horizontal position configured for loading and unloading the plate on the compartment onto and from the imager, respectively, wherein the lifting mechanism is operative to lift and lower the compartments of the magazine one compartment at a time, and wherein the respective rest vertical positions of each of the compartments are lower than the loading vertical position such that a particular compartment pre-loaded with a plate is lifted from its rest vertical position to the loading vertical position, then moved while at the loading vertical position to the loading horizontal position for loading onto the imager.

2. An apparatus to aid loading and unloading of flexographic plates to and from an imager, comprising:

a magazine containing a plurality of compartments each for holding a single flexographic plate, the compartments arranged vertically, and movable in a vertical direction, each respective compartment having a respective rest vertical position at a rest horizontal position, each respective compartment further having a loading vertical position at which the respective compartment is at a height for loading onto the imager;

a lifting mechanism to lift and lower the compartments; and a control system to control the lifting and lowering by the lifting mechanism, such that a particular compartment is moved from its rest vertical position at the rest horizontal position to the loading vertical position at which the particular compartment is at the height for loading onto the imager or unloading from the imager, wherein each compartment has an imaged vertical position, and wherein the lifting mechanism is further operative to lift or lower the particular compartments each from the respective loading vertical position after the plate is imaged and unloaded from the imager to the respective imaged vertical position of the particular compartment.

3. An apparatus to aid loading and unloading of flexographic plates to and from an imager, comprising:

a magazine containing a plurality of compartments each for holding a single flexographic plate, the compartments arranged vertically, and movable in a vertical direction, each respective compartment having a respective rest vertical position at a rest horizontal position, each respective compartment further having a loading vertical position at which the respective compartment is at a height for loading onto the imager;

a lifting mechanism to lift and lower the compartments; and a control system to control the lifting and lowering by the lifting mechanism, such that a particular compartment is moved from its rest vertical position at the rest horizontal position to the loading vertical position at which the particular compartment is at the height for loading onto the imager or unloading from the imager, wherein the compartments are pre-loaded, each with one pre-sensitized CTP flexographic plate such that as a result of the pre-loading, the particular plate is in the compartment without a cover sheet.

4. An apparatus as recited in claim 3, wherein each compartment, when at its loading vertical position, is movable horizontally from and to the rest horizontal position to and from a loading horizontal position suitable for loading and unloading the plate on the compartment onto and from the imager.

5. An apparatus as recited in claim 3, wherein the lifting mechanism is operative to lift and lower the magazine of compartments, and wherein the control system controls the lifting and lowering of the magazine until a selected one of the compartments is at its loading vertical position.

6. An apparatus as recited in claim 3, wherein the lifting mechanism is operative to lift and lower the compartments of the magazine one compartment at a time.

7. An apparatus as recited in claim 3, wherein the magazine is transportable from a storage location to an imaging location adjacent to the imager.

8. An apparatus as recited in claim 3, wherein the magazine comprises at least 10 compartments.

9. A method of loading a flexographic plate to an imager, the method comprising:

(a) pre-loading a particular flexographic plate into a particular compartment of a magazine containing a plurality of compartments each for holding a single flexographic plate, the compartments arranged vertically, and movable in a vertical direction, each respective compartment having a respective rest vertical position at a rest horizontal position, each respective compartment further having a loading vertical position at which the respective compartment is at a height for loading onto the imager or unloading from the imager; and (b) lifting or lowering the particular compartment from its rest vertical position at its rest horizontal position to its loading vertical position, such that the particular flexographic plate can be loaded onto the imager, wherein each compartment, when at its loading vertical position, is movable horizontally from and to the rest horizontal position to and from a loading horizontal position suitable for loading and unloading the plate on the compartment onto and from the imager, wherein step (b) includes lifting or lowering only the particular compartment of the magazine on the basis of one compartment being lifted or lowered at a time, and wherein the respective rest vertical positions of each of the compartments are lower than the loading vertical position such that step (b) includes lifting the pre-loaded particular compartment from its rest vertical position to the loading vertical position, then moving the particular compartment while at the loading vertical position to the loading horizontal position for loading the plate onto the imager.

10. A method of loading a flexographic plate to an imager, the method comprising:

(a) pre-loading a particular flexographic plate into a particular compartment of a magazine containing a plurality of compartments each for holding a single flexographic plate, the compartments arranged vertically, and movable in a vertical direction, each respective compartment having a respective rest vertical position at a rest horizontal position, each respective compartment further having a loading vertical position at which the respective compartment is at a height for loading onto the imager or unloading from the imager; and (b) lifting or lowering the particular compartment from its rest vertical position at its rest horizontal position to its loading vertical position, such that the particular flexographic plate can be loaded onto the imager, wherein step (a) includes pre-loading the particular compartment with a pre-sensitized CTP flexographic plate such that as a result of the pre-loading, the particular plate is in the compartment without a cover sheet.

11. A method of loading a flexographic plate to an imager, the method comprising:

(a) pre-loading a particular flexographic plate into a particular compartment of a magazine containing a plurality of compartments each for holding a single flexographic plate, the compartments arranged vertically, and movable in a vertical direction, each respective compartment having a respective rest vertical position at a rest horizontal position, each respective compartment further having a loading vertical position at which the respective compartment is at a height for loading onto the imager or unloading from the imager; and (b) lifting or lowering the particular compartment from its rest vertical position at its rest horizontal position to its loading vertical position, such that the particular flexographic plate can be loaded onto the imager, the method further comprising:

lifting or lowering the particular compartment from the loading vertical position after the plate is imaged and unloaded from the imager to an imaged vertical position for the particular compartment.

12. A method as recited in claim 11, further comprising:

(c) moving the particular compartment when at its loading vertical position from and to its rest horizontal position to and from a loading horizontal position suitable for loading and unloading the plate on the compartment onto and from the imager.

13. A method as recited in claim 11, wherein step (b) includes lifting or lowering the magazine of compartments until the particular compartment of the particular flexographic plate is at its loading vertical position.

14. A method as recited in claim 11, wherein step (b) includes lifting or lowering only the particular compartment of the magazine on the basis of one compartment being lifted or lowered at a time.

15. A method as recited in claim 11, further comprising transporting the magazine from a storage location to an imaging location adjacent to the imager.

16. A method as recited in claim 11, wherein the magazine comprises at least 10 compartments.

17. A method as recited in claim 11, wherein step (b) is carried out under a computerized control system.

* * * * *